US008931151B2

(12) United States Patent
Wood

(10) Patent No.: US 8,931,151 B2
(45) Date of Patent: Jan. 13, 2015

(54) FENCE STAY DRILL BIT

(75) Inventor: George M Wood, Blossom, TX (US)

(73) Assignees: George M Wood, Blossom, TX (US); Douglass Anthony Williams, Rockwell, TX (US)

( * ) Notice: Subject to any disclaimer, the term of this patent is extended or adjusted under 35 U.S.C. 154(b) by 293 days.

(21) Appl. No.: 13/560,927

(22) Filed: Jul. 27, 2012

(65) Prior Publication Data

US 2013/0026721 A1 Jan. 31, 2013

Related U.S. Application Data

(60) Provisional application No. 61/513,493, filed on Jul. 29, 2011.

(51) Int. Cl.
*B23P 19/04* (2006.01)
*E04H 17/26* (2006.01)

(52) U.S. Cl.
CPC ..... *E04H 17/263* (2013.01); *E04H 17/265* (2013.01)
USPC ..... 29/240; 29/525; 140/117; 279/145

(58) Field of Classification Search
CPC ..... B23P 11/00; B23P 11/02; B23P 19/02; B23P 19/04; B23P 19/06; B23P 19/061; B23B 31/202; B23B 31/1071; B23B 31/207; B23B 13/48
USPC ..... 29/798, 240, 242, 243, 525; 279/142, 279/143, 145; 140/111, 113, 115, 117
See application file for complete search history.

(56) References Cited

U.S. PATENT DOCUMENTS 4,295,395 A * 10/1981 Stifano, Jr. ..... 81/124.7
5,253,406 A * 10/1993 Shere et al. ..... 29/240
2005/0155201 A1* 7/2005 Laxson ..... 29/7.1

* cited by examiner

*Primary Examiner* — Ryan J Walters

(57) ABSTRACT

The present invention is a fence stay drill bit used along with a drill to install and uninstall fence stays more efficiently. The present invention further encompasses a method of installing and uninstalling fence stays using the present invention. The present invention has a drill bit extrusion and an elongated body which houses a slot and a recess. In the preferred embodiment, the elongated body has a cylindrical body which is a safety feature in preventing the present invention from accidentally attaching itself onto objects in the surrounding during use. The elongated body is also attached to a large fillet and a stay receiving lip. Both the recess and the stay receiving lip help guide a tip of a fence stay into the slot therein. The slot has a cavity which traps and stabilizes the tip of fence stay while the present invention is rotated by the drill.

6 Claims, 7 Drawing Sheets

FENCE STAY DRILL BIT

The current application claims a priority to the U.S. Provisional Patent application Ser. No. 61/513,493 filed on Jul. 29, 2011.

FIELD OF THE INVENTION

The present invention relates generally to a drill adaptor and a method of use thereof. Specifically, the present invention is used in installing and uninstalling fence stays. The apparatus is to be used in conjunction with a drill which can rotate in both forward and reverse directions.

BACKGROUND OF THE INVENTION

Domesticated animals on farms and ranches across the country have been contained by fences for years. Many of these fences are made of wire or barbed wire that is supported by fence posts or T-posts. In addition to fence posts, users install fence stays across wire rails between fence posts to stabilize the fence. These fence stays allow the user to place fence posts a distance further apart from each other while maintaining the stretch of the fence with less number of fence posts at a minimum amount of labor. The addition of stays to a fence prevents people and animals from passing through the fence. Furthermore, the addition of fence stays helps strengthen the fence should large animals come in contact with the fence. The traditional method of installing and uninstalling a fence stay is inefficient and can be hazardous to the installer's health. The traditional method requires the installer to twist his or her arms and wrists unfavorably to either install or remove a fence stay. The traditional method is not only a time-consuming process, but it also subjects the user to stress and strain on their arms and wrists. The method may even result in repetitive stress injuries. Therefore, the present invention is not only a drill adaptor but also a method of installing and uninstalling fence stays by using the drill adaptor in a safe and efficient manner.

DETAILED DESCRIPTION OF THE INVENTION

All illustrations of the drawings are for the purpose of describing selected versions of the present invention and are not intended to limit the scope of the present invention.

Figure 1:
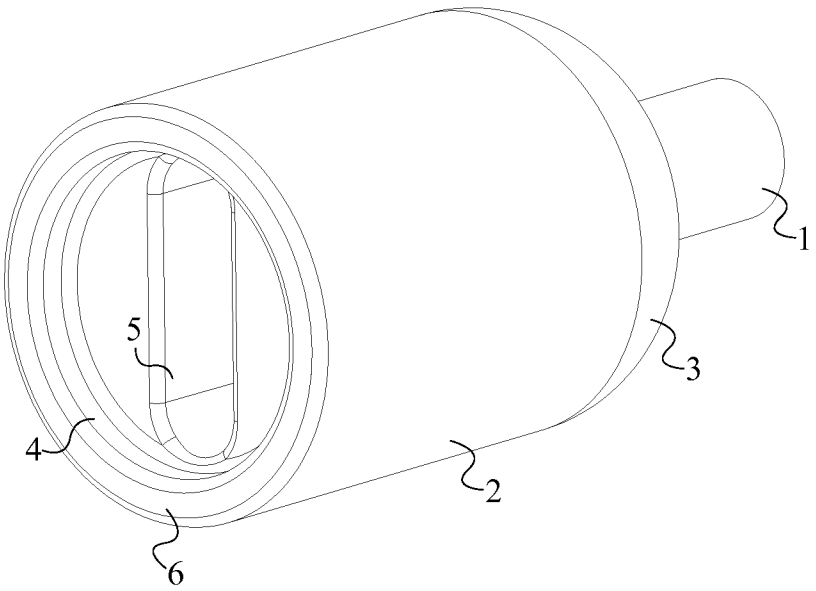
FIG. 1 is a perspective view of the preferred embodiment of the present invention.
Figure 2:
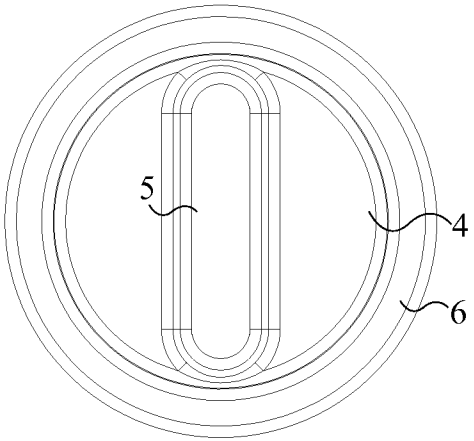
FIG. 2 is a bottom view of the preferred embodiment of the present invention.
Figure 3:
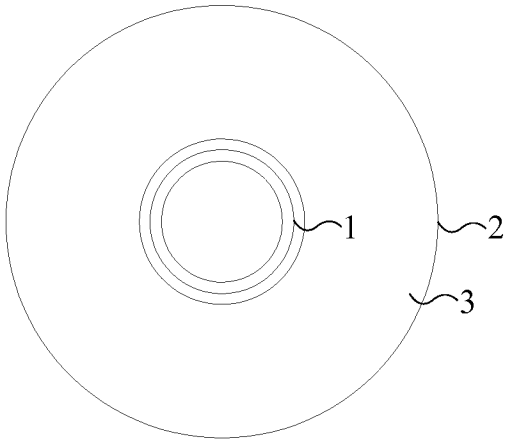
FIG. 3 is a top view of the preferred embodiment of the present invention.
Figure 4:
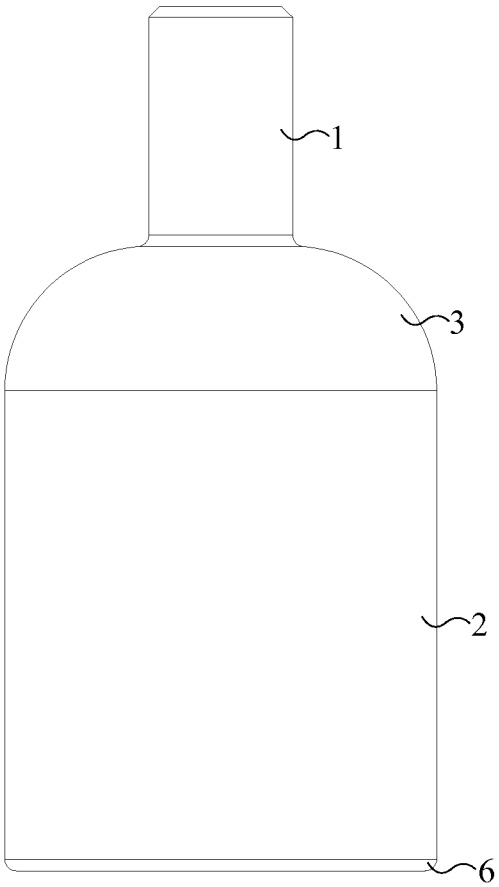
FIG. 4 is a lateral view of the preferred embodiment of the present invention.
Figure 5:
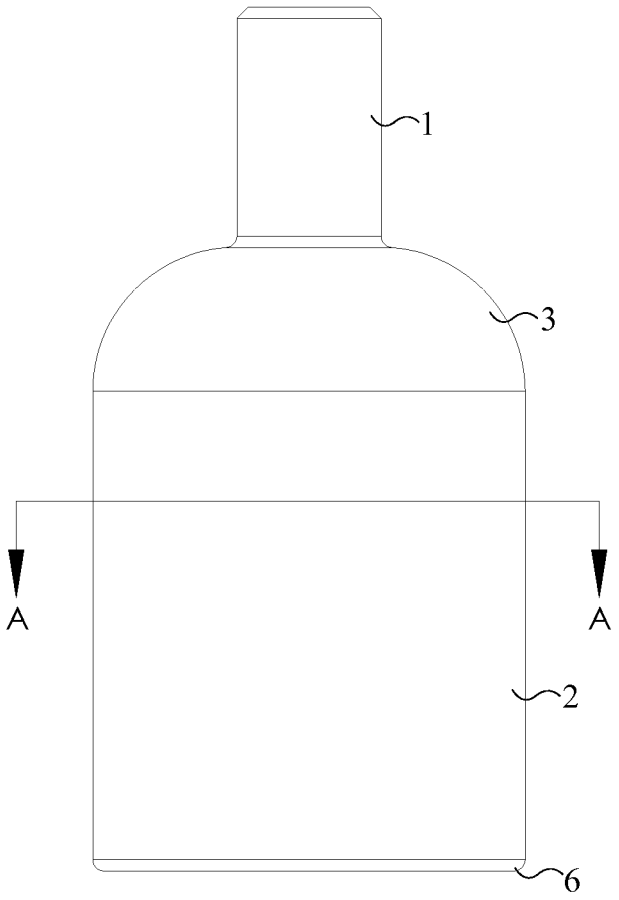
FIG. 5 is a lateral view of the preferred embodiment of the present invention, showing the plane upon which a top cross-sectional view is taken and shown in FIG. 6.
Figure 6:
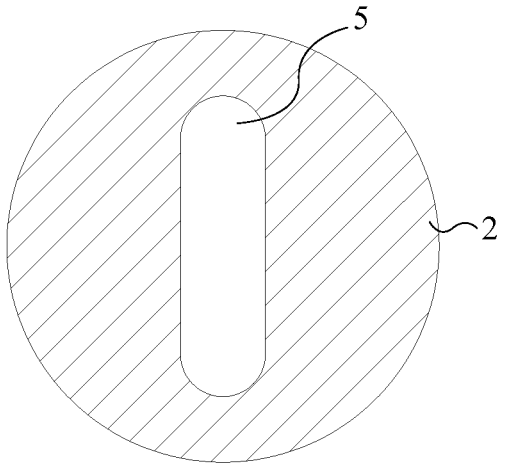
FIG. 6 is a top cross-sectional view of the preferred embodiment of the present invention taken along line A-A of FIG. 5.

The present invention is a fence stay drill bit and a method of use thereof. Specifically, the present invention is an adaptor to be used with a drill to drive or install fence stays. As shown from FIG. 1 to FIG. 10, the preferred embodiment of the present invention resembles a large socket used on a cordless drill with the exception of a slot 5 cut across the upper face in a bisecting manner as shown in FIG. 6. In the preferred embodiment, the length of the present invention is 2.25 inches. The fence stay drill bit is comprised of a drill bit extrusion 1 and an elongated body 2. The length of the drill bit extrusion 1 is 0.60 inches as the tip of the drill bit extrusion 1 is a chamfer with a length of 0.03 inches and angle of 45 degrees. Therefore, the diameter of the tip of the drill bit extrusion 1 is 0.38 inches. As shown in FIG. 4, the bottom of the drill bit extrusion 1 is also a conjunction between the drill bit extrusion 1 and the top of the elongated body 2. The conjunction has a radius of 0.03 inches. As illustrated in FIG. 4, the drill bit extrusion 1 is an elongated cylindrical body concentrically connected to the elongated body 2, which is a bigger elongated cylindrical body in the preferred embodiment. The drill bit extrusion 1 is connected adjacent to the elongated body 2. It is understood that the cross section of the drill bit extrusion 1 can be any arbitrary shape. The shapes include circle, square, polygonal and irregular. The shape of the cross section is designed to fit complementarily into a drill chuck of the drill. The diameter of the elongated body 2 is bigger than the diameter of the drill bit extrusion 1 due to components housed by the elongated body 2. In the preferred embodiment, the diameter of the elongated body 2 is 1.13 inches. The components housed by the elongated body 2 are a slot 5 and a recess 4 as shown in FIG. 1. Furthermore, the components attached to the elongated body 2 are a large fillet 3 and a stay receiving lip 6. As shown in FIG. 2 and FIG. 3, the slot 5, the recess 4, the large fillet 3 and the stay receiving lip 6 are all positioned concentrically with each other on the elongated body 2.

The slot 5 and the recess 4 are positioned opposite to the drill bit extrusion 1 on the elongated body 2. In addition to the slot 5 and the recess 4, the stay receiving lip 6 is also positioned opposite to the drill bit extrusion 1 on the elongated body 2. As illustrated in FIG. 1, the slot 5, the recess 4 and the stay receiving lip 6 are all positioned opposite to the large fillet 3 and the drill bit extrusion 1. The slot 5 traverses centrally through the recess 4 and into the elongated body 2, opposite to the drill bit extrusion 1. As illustrated in FIG. 1, FIG. 2 and FIG. 6, the slot 5 is comprised of a racetrack-shaped lateral surface and a cavity delineated by the racetrack-shaped lateral surface. Specifically, the slot 5 is a pair of circles connected by parallel tangential lines with a depth. In the preferred embodiment, the diameter of both circles is 0.25 inches whereas the distance between the parallel tangential lines is 0.25 inches. The distance between the parallel tangential lines is a narrow width of the slot 5. The half distance between the parallel tangential lines is 0.12 inches. The longitudinal distance between the center of each circle is 0.56 inches.

Figure 8:
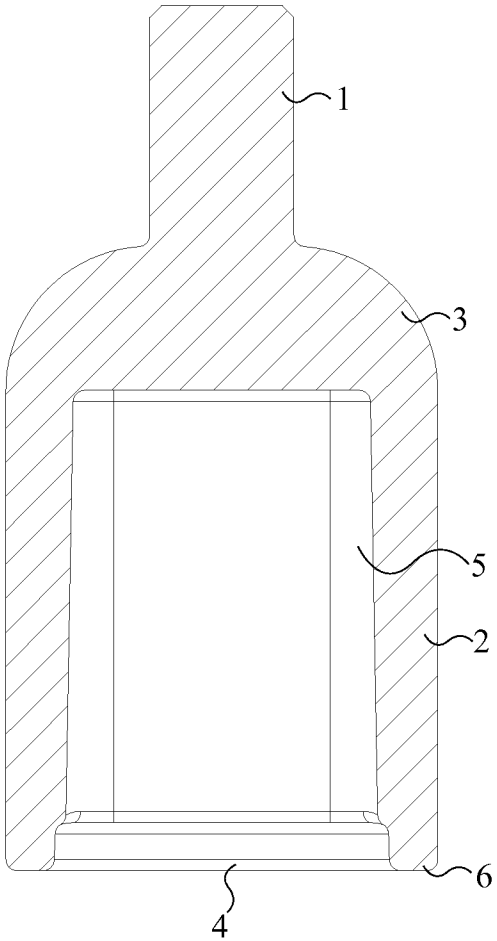
FIG. 8 is a lateral cross-sectional view of the preferred embodiment of the present invention taken along line B-B of FIG. 7.
Figure 7:
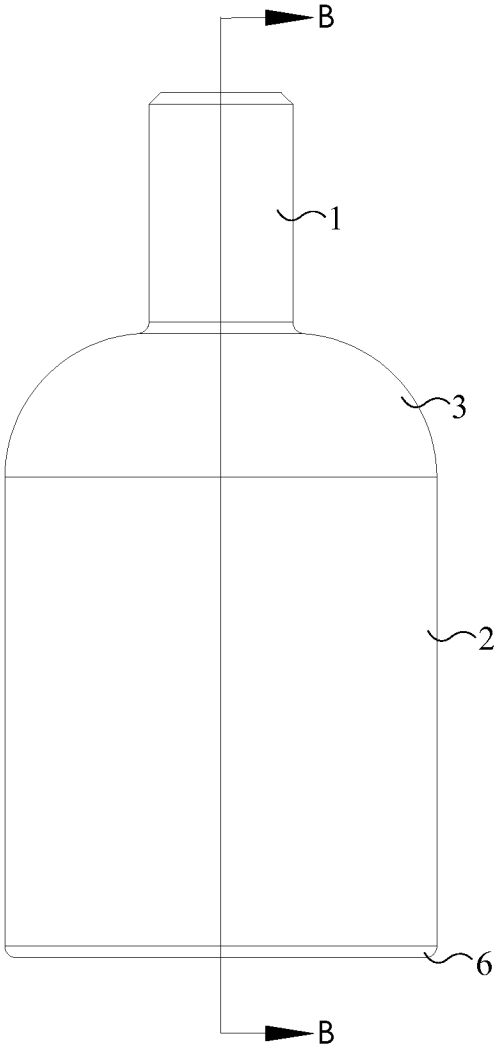
FIG. 7 is a lateral view of the preferred embodiment of the present invention, showing the plane upon which a lateral cross-sectional view is taken and shown in FIG. 8.
Figure 10:
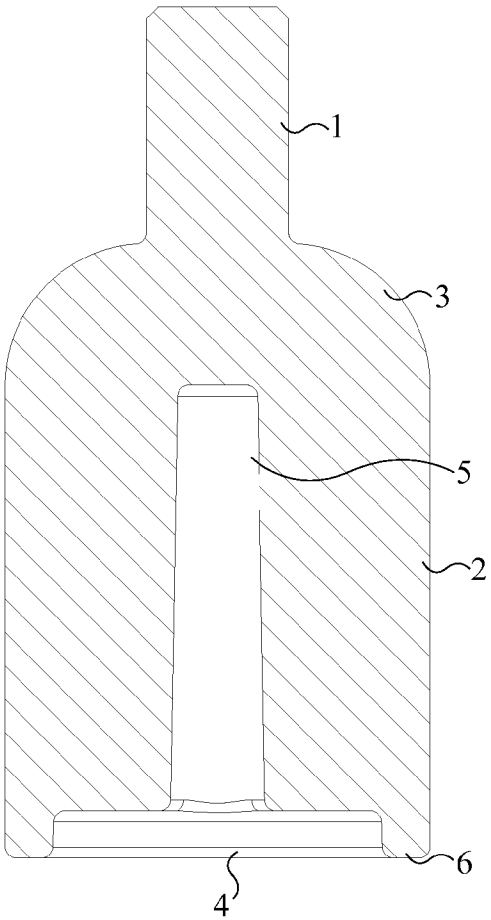
FIG. 10 is a lateral cross-sectional view of the preferred embodiment of the present invention taken along line C-C of FIG. 9.
Figure 9:
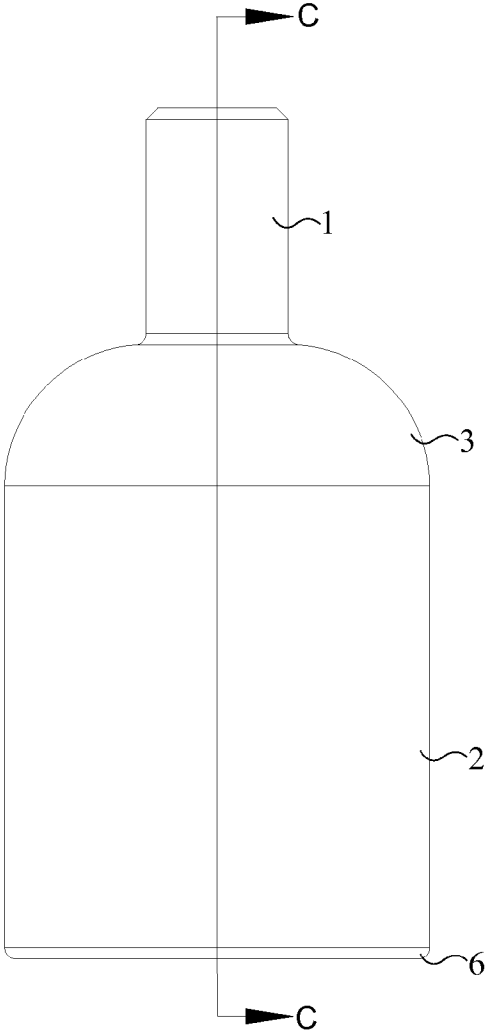
FIG. 9 is a lateral view of the preferred embodiment of the present invention, showing the plane upon which a lateral cross-sectional view is taken and shown in FIG. 10.

In the preferred embodiment, the length or the depth of the cavity is 1.25 inches, but due to an affixation of a fillet with a radius 0.03 inches to the end circumferential edge of the cavity, the offset depth of the cavity is reduced to 1.22 inches. The front narrow width of the cavity is 0.25 inches. The back narrow width of the cavity is 0.21 inches because the back narrow width of the cavity is offset by another fillet with a radius of 0.03 inches. The wide width of the cavity or the length of the slot 5 is 0.81 inches. The wide width of the cavity or the length of the slot 5 is reduced to 0.77 inches as the cavity traverses into the elongated body 2 as shown in FIG. 1, FIG. 8 and FIG. 10. The offsetting of the length of the slot 5 is due to an addition of another fillet with a radius of 0.03 inches to the end circumferential edge of the cavity. As shown in FIG. 10, the back narrow width of the cavity is shorter than the front narrow width of the cavity due to an offset fillet affixed to the circumferential edge of the back narrow width. The fillet has a radius of 0.03 radius. The back narrow width of the cavity is where the large fillet 3 starts forming with a radius of 0.38 inches. Furthermore, the back narrow width is in close proximity with the drill bit extrusion 1. Both of the slot 5 and the recess 4 are contained within the elongated body 2. Specifically, both of the slot 5 and the recess 4 are concentrically positioned with each other on, and along the elongated body 2. The slot 5 and the recess 4 are positioned in such a manner wherein the slot 5 and the recess 4 are aligned serially and collinearly. As illustrated in FIG. 1, FIG. 2, FIG. 8, and FIG. 10, the recess 4 is a circular hollow space preceding the slot 5. In the preferred embodiment, the recess 4 has a diameter of 0.87 inches. The recess 4 gives the slot 5 a receded appearance inside the elongated body 2. Furthermore, the slot 5 is encircled by a stay receiving lip 6. In addition to the slot 5, the recess 4 is also encircled by the stay receiving lip 6 as shown in FIG. 2. Both the recess 4 and the stay receiving lip 6 help guide a tip of a fence stay into the slot 5 therein. The cavity of the slot 5 traps and stabilizes the tip of fence stay while the present invention is rotated by the drill.

In addition to the drill bit extrusion 1, the elongated body 2 is also attached to the large fillet 3 and the stay receiving lip 6 as illustrated in FIG. 4, FIG. 5, FIG. 7 and FIG. 9. As shown in FIG. 1 and FIG. 2, the diameter of the stay receiving lip 6 is slightly smaller than the diameter of the elongated body 2. The diameter of the stay receiving lip 6 is offset from the diameter of the elongated body 2 by a fillet with a radius of 0.03 inches. Therefore, the inner diameter of the stay receiving lip 6 is 0.93 inches as illustrated. At the conjunction between the drill bit extrusion 1 and the elongated body 2 is the large fillet 3. The large fillet is positioned adjacent to the drill bit extrusion 1, on the elongated body 2. In the preferred embodiment, the large fillet 3 is a curved circumferential edge connecting the drill bit extrusion 1 and the elongated body 2. The affixation of the large fillet 3 to the conjunction between the drill bit extrusion 1 and the elongated body 2 eliminates the sharp circumferential edge between the drill bit extrusion 1 and the elongated body 2. With the sharp circumferential edge replaced by the large fillet 3 and a cylindrical shape of the elongated body 2, the present invention is thus prevented from accidentally attaching itself onto objects in the surrounding. These objects include clothing articles and jewelry adorned by the user. Therefore, the large fillet 3 and the cylindrical shape of the elongated body 2 serve as safety features. The drill bit extrusion 1 is not only concentrically positioned with the elongated body 2, but the drill bit extrusion 1 is connected adjacent to the elongated body 2 as shown in FIG. 3 and FIG. 4. The smaller diameter of the drill bit extrusion 1 allows the drill bit extrusion 1 to be captured and thus engaged by the drill chuck of the drill. Once powered by the drill, the drill bit extrusion 1 is rotated axially about its length. The rotations of the drill bit extrusion 1 cause the elongated body 2 to rotate axially about its length through mechanical power transmission. Once the elongated body 2 is rotated axially about its length, the large fillet 3, the slot 5, the recess 4 and the stay receiving lip 6 are also rotated axially. Once engaged to the slot 5, the tip of the fence stay can thus rotate when the present invention rotates.

The present invention also comprises a method of installing and uninstalling fence stays by utilizing the fence stay drill bit, which is initiated by inserting a drill bit extrusion 1 of the fence stay drill bit into a drill in a conventional manner. The drill may be either corded or cordless. A fence stay is placed on the top wire rails of a fence as the present invention is placed on top of the fence stay. The drill is then set to the lowest rotational speed. A tip of a fence stay is inserted into a slot 5 of the fence stay drill bit. With the drill activated, the user may install the fence stay by rotating the fence stay and the fence stay drill bit clockwise with the drill while he or she holds onto the fence stay and the wire rails. With the present invention attached to the tip of the fence stay, the fence stay is driven and screwed across the remaining fence rails in a speedy and efficient manner. With the drill activated, the user may uninstall the fence stay quickly by operating the drill in reverse. To uninstall the fence stay, the user rotates the fence stay and the fence stay drill bit counter-clockwise with the drill while he or she holds onto the fence stay. In installing the fence stay by rotating the fence stay and the fence stay drill bit clockwise with the drill, the fence stay can be manually installed and guided into the top wire rails prior to the engagement of the drill to drive the fence stay into the bottom wire rails.

The method of installing and uninstalling fence stays by utilizing the fence stay drill bit is in sharp contrast to the usual tiring manual installation of fence stays. The method provides the user an ability to install and uninstall fence stays in a quick, easy, safe and efficient manner. The present invention has many features that make it beneficial to both consumers and potential manufacturers. A fence stay installation aid such as the present invention allows for quick installation and uninstallation of fence stays on wire fences with power provided from a cordless or corded drill. With a powered drill, the present invention is used to drive stays across wire fence rails in an efficient manner. The method eliminates the traditional, time-consuming process of driving fence stays by hand. The method saves time and money. Furthermore, the method eliminates repetitive stress injuries caused by the traditional method which requires the user to constantly twist his or her wrists. The present invention resembles a large socket with a slot 5 cut across the face of the present invention. The fence stay drill bit is designed to fit all types of fence stays. Moreover, the present invention can be used with any type of drill that is operable in both forward and reverse directions to allow the user to install and uninstall fence stays efficiently. With the present invention, the installation time is reduced from 32 seconds to only 6 seconds.

The present invention is made of strong and durable materials. Although any suitable material may be used, the material of construction of the preferred embodiment of the present invention is steel. The present invention can also be manufactured using recycled aluminum. The present invention uses known technology and has a cost effective design.

Although the invention has been explained in relation to its preferred embodiment, it is to be understood that many other possible modifications and variations can be made without departing from the spirit and scope of the invention as hereinafter claimed.

What is claimed is:

1. A fence stay drill bit comprising, a drill bit extrusion;

an elongated body;

the elongated body comprising a large fillet, a slot, a recess and a stay receiving lip;

the drill bit extrusion being concentrically connected to the elongated body;

the drill bit extrusion being connected adjacent to the elongated body;

the slot traversing centrally into the elongated body opposite to the drill bit extrusion;

the large fillet being positioned adjacent to the drill bit extrusion on the elongated body;

the slot being positioned opposite to the drill bit extrusion on the elongated body;

the recess being positioned opposite to the drill bit extrusion on the elongated body;

the stay receiving lip being positioned opposite to the drill bit extrusion on the elongated body;

the slot comprising a racetrack-shaped lateral surface and a cavity; and the cavity being delineated by the racetrack-shaped lateral surface.

2. The fence stay drill bit as claimed in claim 1 comprises, the large fillet, the slot, the recess and the stay receiving lip being positioned concentrically with each other.

3. The fence stay drill bit as claimed in claim 2 comprises, the slot being encircled by the stay receiving lip; and the recess being encircled by the stay receiving lip.

4. A method of installing and uninstalling fence stays by utilizing a fence stay drill bit comprises the steps of:

a) inserting a drill bit extrusion of the fence stay drill bit into a drill;

b) setting the drill to the lowest rotational speed;

c) inserting a tip of a fence stay into a slot of the fence stay drill bit;

d) installing the fence stay by rotating the fence stay and the fence stay drill bit clockwise with the drill while holding onto the fence stay and a plurality of wire rails; and e) uninstalling the fence stay by rotating the fence stay and the fence stay drill bit counter-clockwise with the drill while holding onto the fence stay.

5. The method of installing fence stays by utilizing a fence stay drill bit as claimed in claim 4, wherein step (d) includes manually installing and guiding the fence stay onto top wire rails prior to installing the fence stay by rotating the fence stay and the fence stay drill bit clockwise with the drill.

6. A fence stay drill bit comprising, a drill bit extrusion;

an elongated body;

the elongated body comprising a large fillet, a slot, a recess and a stay receiving lip;

the drill bit extrusion being concentrically connected to the elongated body;

the drill bit extrusion being connected adjacent to the elongated body;

the slot traversing centrally into the elongated body opposite to the drill bit extrusion;

the large fillet being positioned adjacent to the drill bit extrusion on the elongated body;

the slot being positioned opposite to the drill bit extrusion on the elongated body;

the recess being positioned opposite to the drill bit extrusion on the elongated body;

the stay receiving lip being positioned opposite to the drill bit extrusion on the elongated body;

the slot comprising a racetrack-shaped lateral surface and a cavity;

the cavity being delineated by the racetrack-shaped lateral surface;

the large fillet, the slot, the recess and the stay receiving lip being positioned concentrically with each other;

the slot being encircled by the stay receiving lip; and the recess being encircled by the stay receiving lip.

* * * * *